US005887636A

United States Patent [19]

Neukam

[11] Patent Number: 5,887,636

[45] Date of Patent: Mar. 30, 1999

[54] VENETIAN BLIND

[76] Inventor: Helmut Neukam, Anton-Bruckner-Weg 10, A-8071 Hausmannstätten, Austria

[21] Appl. No.: 885,529

[22] Filed: Jun. 30, 1997

[51] Int. Cl.[6] ..... E06B 9/08

[52] U.S. Cl. ..... 160/133; 49/74.1

[58] Field of Search ..... 160/33, 201; 49/86.1, 49/74.1

[56] References Cited

U.S. PATENT DOCUMENTS

| | | | |
|---|---|---|---|
| 3,302,692 | 2/1967 | Grau | 160/133 |
| 3,429,355 | 2/1969 | Griesser | 160/133 |
| 3,989,084 | 11/1976 | Inamura et al. | 160/133 X |
| 4,449,563 | 5/1984 | Toda et al. | 49/74.1 X |
| 5,566,737 | 10/1996 | Erber | 160/133 |

FOREIGN PATENT DOCUMENTS 0330 192 8/1989 European Pat. Off. .

*Primary Examiner*—Blair M. Johnson

*Attorney, Agent, or Firm*—Collard & Roe, P.C.

[57] ABSTRACT

A louverable roller shutter comprises a series of adjacent slats extending parallel to an axis of a winding drum, a vertical guide at each end of the slats, guide bodies received in the vertical guides and tiltably connected to the ends of the slats, a tension element displaceably guided in the guide bodies for being wound up on the winding drum, slat tilting bodies received in the vertical guides on a side of the guide bodies averted from the slat ends, and a slat tilting element displaceably guided in the slat tilting bodies for being wound up on the winding drum. The tension element and the slat tilting element are comprised of at least one thin, flexible metal strip defining holes, pins substantially perpendicularly intersecting the axis of the winding drum are connected to a respective one of the guide bodies and the slat tilting bodies, the pins passing through the holes in the thin, flexible metal strips, and shafts are torsionally rigidly connected to the slat ends and extending parallel to the slats, each shaft passing through a respective one of the guide bodies and having an offset portion pivotally engaging a respective one of the slat tilting bodies.

9 Claims, 4 Drawing Sheets

VENETIAN BLIND

BACKGROUND OF THE INVENTION

1. Field of the Invention

The present invention relates to a louverable roller shutter for covering an opening and comprising a series of adjacent slats extending parallel to an axis of a winding drum, a vertical guide at each end of the slats, guide bodies received in the vertical guides and tiltably connected to the ends of the slats, a tension element displaceably guided in the guide bodies for being wound up on the winding drum, slat tilting bodies received in the vertical guides on a side of the guide bodies averted from the slat ends, and a slat tilting element displaceably guided in the slat tilting bodies for being wound up on the winding drum.

2. Description of the Prior Art

Such roller shutters are known, for example from EP 330 192 A1. In these known roller shutters, the guide bodies are linked together by axles extending parallel to the axis of the winding drum and serve also as tension elements. Each of the tension element members has a height corresponding to the width of the slats. The slat tilting element is similarly configurated, the members of the chain-like slat tilting element being interconnected and connected to the slats by pivot axes extending parallel to the winding drum. The pivot axes project from connecting parts at the ends of the slats, the connecting parts ensuring the required offset between tension and slat tilting elements and having a central space for the slat tilting bodies.

These roller shutters have the disadvantage of requiring a relatively complex manufacture. The members of the tension and slat tilting elements must be made of specially profiled parts different from those of the slats, which requires high costs for the production of the required tools and forms.

SUMMARY OF THE INVENTION

It is an object of this invention to avoid these disadvantages and to build a roller shutter of the above-described type, which may be produced simply and at low cost.

This is accomplished according to the invention with such a roller shutter wherein the tension element and the slat tilting element are comprised of at least one thin, flexible metal strip defining holes, pins substantially perpendicularly intersecting the axis of the winding drum are connected to a respective one of the guide bodies and the slat tilting bodies, the pins passing through the holes in the thin, flexible metal strips, and shafts are torsionally rigidly connected to the slat ends and extend parallel to the slats, each shaft passing through a respective one of the guide bodies and having an offset portion pivotally engaging a respective one of the slat tilting bodies.

This provides a very simple structure of the tension and slat tilting elements, which may simply be formed by thin metal strips and may be made by cutting with scissors. Specially profiled parts are no longer required, which involved a very costly production by injection or extrusion molding.

Because of the flexibility of the tension and slat tilting elements, the roller shutter of the invention may be wound on winding drums of relatively small diameter, for example 6 cm, the diameter being determined substantially, as conventional, by the width of the slats.

The invention has the further advantage that the slats may be connected to the guide and slat tilting bodies by simply manufactured connecting parts. For this purpose, a steel wire of a diameter of about 1 mm to 2 mm, for example, may serve as the connecting shaft, which is cranked after it has been inserted in the guide body, the offset shaft end then being inserted into the slat tilting body.

The invention does away with the conventional, often quite complicated connecting parts, particularly those between the slats and the slat tilting bodies, which usually are positioned behind the guide bodies and, therefore, have a complicated shape.

According to an advantageous embodiment, the thin, flexible metal strips of the tension element and of the slat tilting element comprise a plurality of overlapping members forming chains, each member defining two of said holes, the holes being elongated to extend in a longitudinal direction and the center points of the elongated holes being spaced from each other a distance corresponding to the width of the slats, and each of the pins passing through registering ones of the holes in the overlapping members. This has the advantage that the overlapping members may be assembled to form tension and slat tilting elements of any desired length, and any desired measures may, therefore, be produced with stored members. Furthermore, the slats may be slightly spaced from each other in the position in which the roller shutter covers a window opening so that small gaps are formed between the slats. This may be achieved simply by dimensioning the slots in the overlapping members so that their length over the entire length of the roller shutter remains the same while slots in a continuous tension or slat tilting element must become larger from bottom to top in the lowered position of the roller shutter.

A defined position of the slats in their closing position can be obtained if the guide bodies comprise lateral lugs extending towards the slat ends, the lugs providing stops defining the closing position.

DE 29 29 675 discloses a roller shutter wherein at least one of the slat tilting bodies is connected with a louvering hook engaging a louvering rocker arranged in the vertical guide, the louvering rocker defining a substantially vertically extending inlet slot and an inclined duct downwardly branching off the inlet slot. The slats are interconnected at their longitudinal edges remote from the axes by textile connecting elements, only one slat titling body being provided, which is connected with these longitudinal edges. This connection of the slats has the disadvantage that textile connecting elements age quickly under the impinging solar radiation and become brittle. The functioning of the roller shutter is disturbed when one of the connecting elements breaks. Furthermore, the louvering rocker projects beyond the guide rails so that cleaning exposes the cleaner to the danger of injuries.

For this reason, it is advantageous if the inclined duct leads to a substantially vertical catch duct having a lower end defined by a downwardly inclined outlet plane, a catching hook is arranged above the point where the inclined duct branches off the inlet slot and is downwardly open for engaging the louvering hook, an end of the inclined outlet plane leading to a substantially vertical sliding duct, and a switch tongue is arranged at the end of the inclined outlet plane, the switch tongue being held above the inclined outlet plane on a wall separating the sliding duct from the catch duct, and the switch tongue having a free end and being pivotal between a rest position wherein the switch tongue is downwardly inclined and the free switch tongue end engages the inclined inlet plane of the vertical catch duct, and a position wherein the free switch tongue end is pivoted into the vertical sliding duct.

This has the advantage that the connecting elements of the slat tilting bodies may be guided in the guide protected from wind and weather, as well as manipulations from the outside. The louvering rocker may be quite small and arranged within the cross section of the guide.

It is also possible to arrange louvering rockers at several locations of the guide so that the slats may be properly oriented in different positions of the roller shutter. The switch tongue assures that the roller shutter may always be dependably pulled up without interference of the louvering hook. All that is required is to lower the roller shutter sufficiently to permit the louvering hook to enter into the sliding duct in which it may be pulled up again without problems. This produces a very user-friendly operation.

The tension and slat tilting elements may either be flexible themselves or may be comprised of thin, flexible members of spring steel strips, for example, the only requirement being that they can sustain the operating tension. Holding the slats above their point of gravity will assure that gravity will cause them to assume their closing position in which the slats extend parallel to the plane of the opening to be covered while operating force is required to bring them into the louvered position.

According to an advantageous feature, the louverable roller shutter further comprises an inclined switch tongue having a free end and resiliently covering the inlet slot, the inclined switch tongue being held on a wall separating the vertical sliding duct from the inlet slot and extending obliquely upwardly over the sliding duct. This has the advantage that the louvering hook will securely enter the inlet slot in the louvering rocker when the roller shutter is lowered and cannot glide into the sliding duct, in which the louvering hook cannot be caught.

A very simple structure is produced if the switch tongues are of spring steel and may be simply affixed to the louvering rocker, for example by spot welding or gluing.

BRIEF DESCRIPTION OF THE DRAWING

The invention will now be explained in more detail with reference to the accompanying drawing, wherein.

DETAILED DESCRIPTION OF PREFERRED EMBODIMENT

Figure 1:
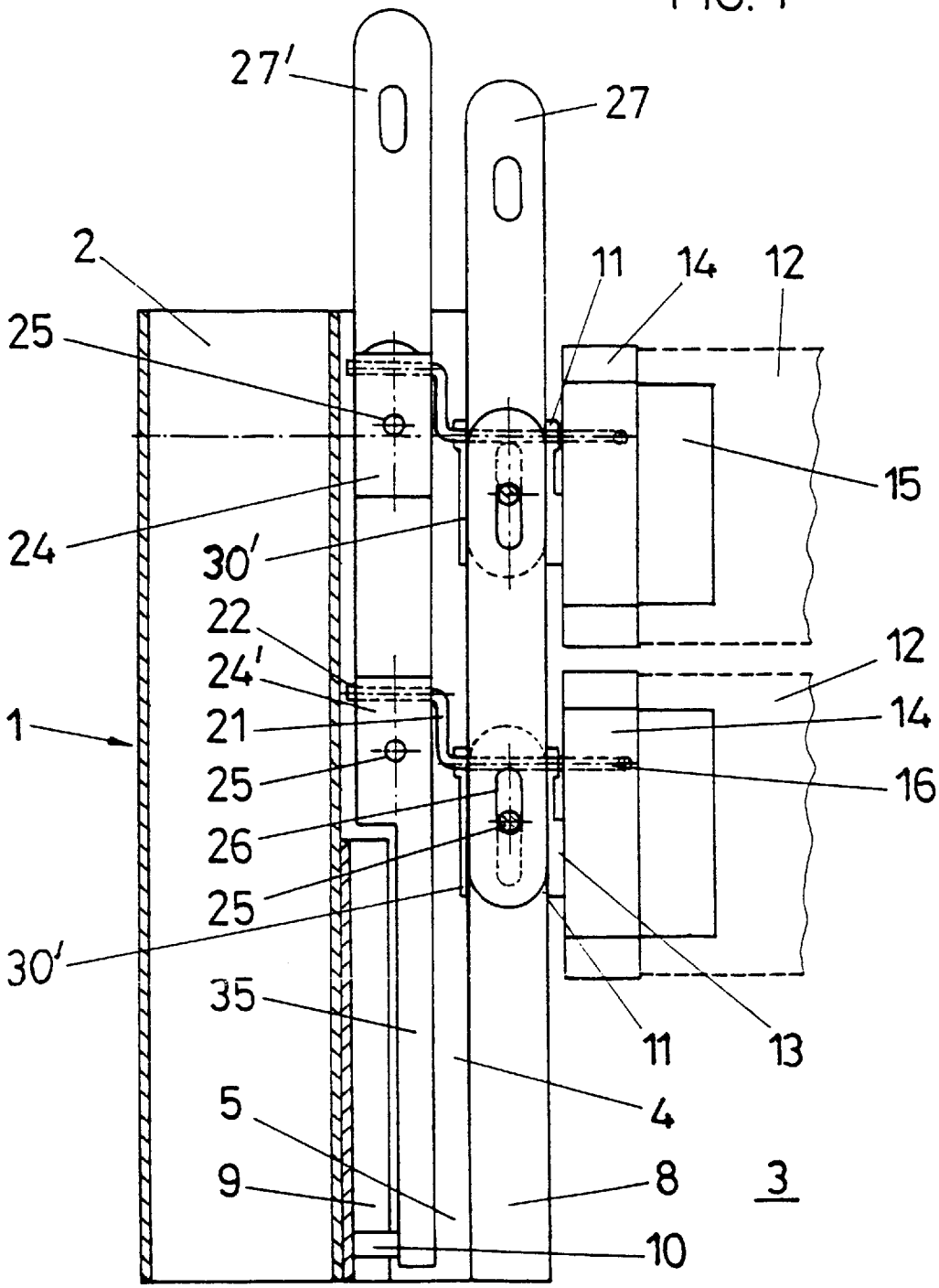
FIG. 1 is a fragmentary side elevational view of a lower portion of a roller shutter according to this invention, partly in section.
Figure 2:
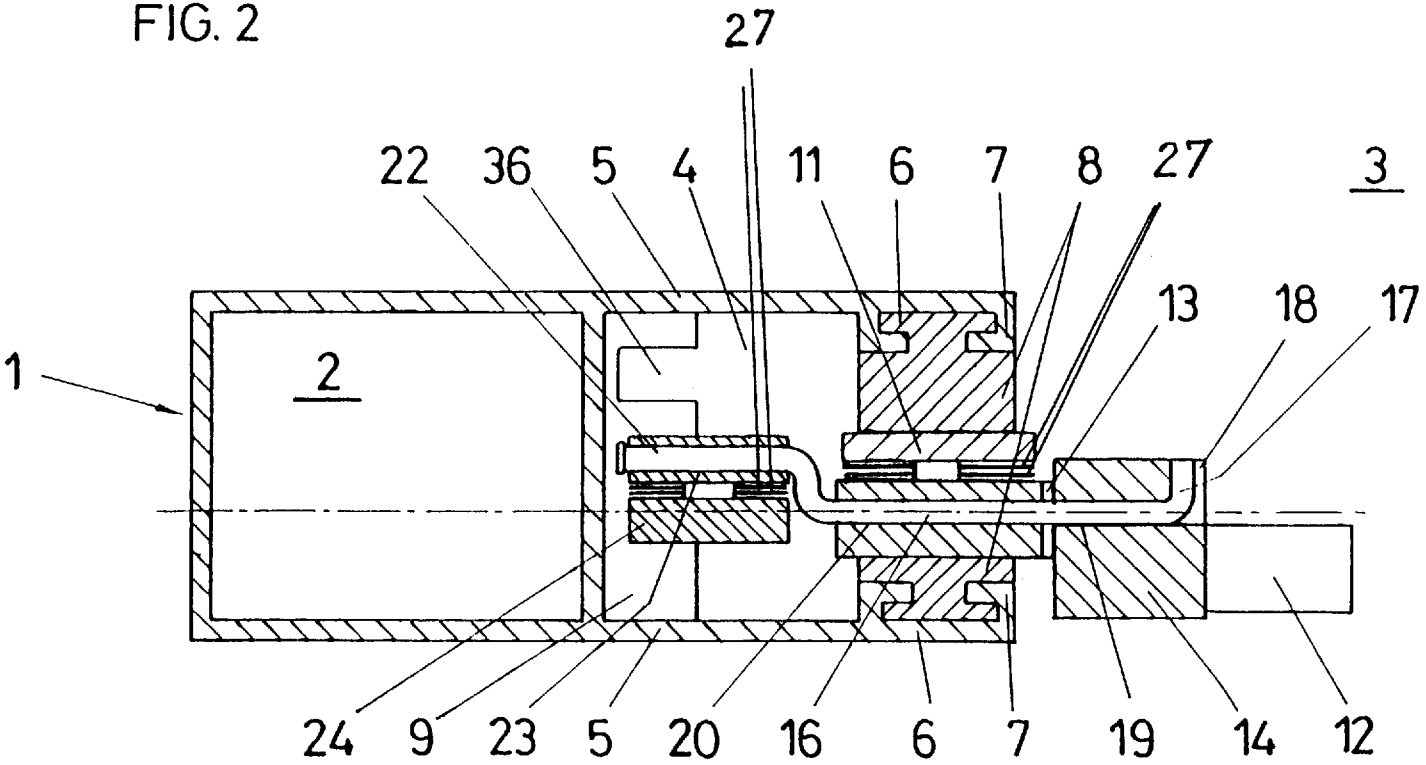
FIG. 2 shows a transverse cross section of FIG. 1.

Referring first to FIGS. 1 and 2, the roller shutter is shown to comprise vertical guide 1 at each end of slats 12. In the illustrated embodiment, the guide is arranged in a reveal of wall opening 3 and has a closed chamber 2 and a chamber 4 which is open towards opening 3 and is delimited by legs 5. Guide tracks 7 at the ends of legs 5 define grooves 6 of T-shaped cross section, and guide rails 8 of plastic material are inserted in grooves 6.

Louvering rocker 9 and cooperating louvering hook 10 of slat tilting body 24' are arranged at least in the lowest portion of open chamber 4 (as described hereinafter in connection with FIG. 6).

Guide bodies 11 are guided between guide rails 8 and have lugs 13 laterally projecting towards slats 12. The lugs serve as stops for limiting the tilting movement of the slats in their closed position. When slats 12 are tilted into their louvered position, wherein adjacent slats define gaps therebetween and the slats extend substantially perpendicularly to the plane of opening 3, the slats are spaced from lugs 13 of guide bodies 11.

Crank shafts 16 pass through guide bodies 11 and are torsionally rigidly connected to holders 14 of slats 12. The holders have projections 15 extending into slats 12, which are hollow bodies connected to the projections of the holders. As shown in FIG. 2, the torsionally rigid connection of shaft 16 to slat holder 14 is effected by the engagement of bent shaft portion 17 in recess 18 at the end of the holder facing the slat. Shaft 16 passes through bore 19 in holder 14 and bore 20 in guide body 11.

Figure 5:
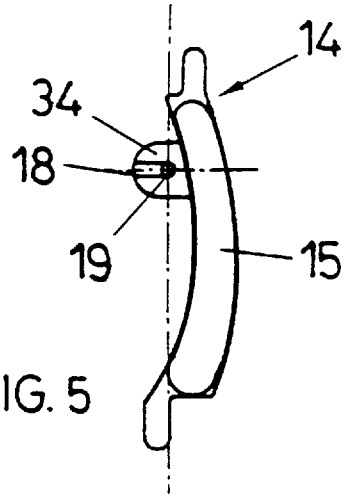
FIG. 5 is a side elevational view of a holder of a slat.

As may be seen in FIGS. 1, 2 and 5, each slat 12 is held eccentrically relative to its point of gravity, shaft 16 being connected to slat holder 14 above this point so that the slats will be positioned by gravity substantially parallel to the plane of opening 3 and will rest against lugs 13 of guide bodies 11.

The end of shaft 16 opposite bent shaft portion 17 is formed by crank portion 21 and offset shaft portion 22 passing through bore 23 in slat tilting body 24, bores 23 and 20 extending parallel to each other.

Figure 4:
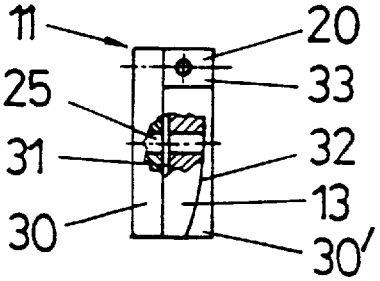
FIG. 4 is a side elevational view, partly in section, of a guide body.

As best shown in FIG. 4, guide bodies 11 are comprised of two parts 30 and 30', and the guide body parts are interconnected by pins 25 extending substantially perpendicularly to bores 20 in the guide bodies. In addition, pins 25 also pass through registering slots 26 of two overlapping members 27 of a thin, flexible material, such as spring steel. In this way, members 27 form a chain constituting a thin, flexible tension element connected to guide bodies 11. This tension element may be wound up on a non-illustrated winding drum which extends parallel to slats 12.

Figure 3:
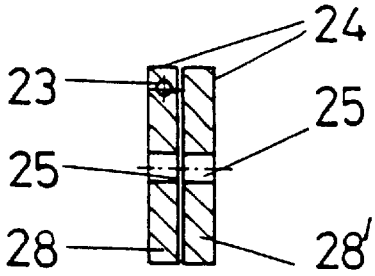
FIG. 3 is a sectional view of a slat tilting body.

As best shown in FIG. 3, slat tilting bodies 24 are also comprised of two parts 28 and 28', and these parts are also interconnected by pins 25. These pins, too, pass through registering slots 26 of two overlapping members 27' which are substantially of the same form as members 27 and form a thin, flexible slat tilting element connected to slat tilting bodies 24. As shown in FIG. 1 and will be explained more fully in connection with FIG. 6, a slat tilting body 24' at the bottom of guide 1 is integral with extension 35 carrying a louvering hook.

As shown in FIG. 3, parts 28, 28' of slat tilting body 24 are flat platelets defining bores 29 receiving pins 25. Part 28 additionally has bore 23 for receiving offset shaft portion 22 of crank shaft 16. Parts 28, 281 are assembled by gluing or riveting pins 25 after members 27' have been inserted in the slat tilting bodies, care being taken that members 27' are displaceable relative to each other in the longitudinal direction.

As can be seen in FIG. 4, parts 30, 30' of guide bodies 11 define grooves 31 between their facing sides, which grooves receive members 27 of the tension element for free movement therethrough. The edges of guide body parts 30, 30' are in contact with each other.

As shown in FIG. 5, each slat holder 14 has a concave rear side, and lug 34 projects from an upper portion thereof and defines bore 19 receiving shaft 16 and bore 18 receiving bent shaft portion 17, which assures a torsionally rigid entrainment of slat holder 14. The slat holder also comprises projection 15 entering the hollow inside of slat 12 and connected thereto, for instance by gluing.

Slats 12 may be rolled up in a conventional manner by rotating a winding drum extending parallel to the slats, which exerts a pulling force on the tension element comprised of members 27. As is well known, a stop for the rotation of the winding drum may be provided, for example a traction rope which may be wound up, to hold the tension element and the slats connected thereto in a desired position. When the traction rope is released, the tension element is reeled off the winding drum and guide bodies 11 slide down guide 1. Slat tilting bodies 24 and the slat tilting element substantially synchronously move with the tension element and the guide bodies while slats 12 engage lugs 13 of the guide bodies.

Figure 6:
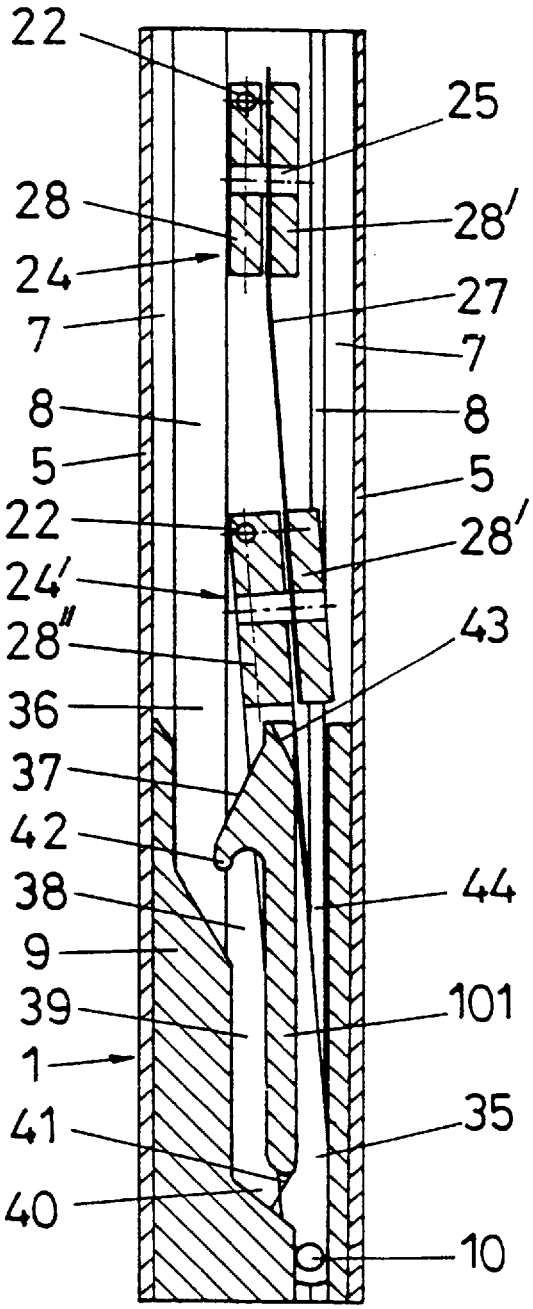
FIG. 6 shows a louvering rocker in longitudinal section.

As can be seen from FIGS. 2 and 6, only guide bodies 11 are laterally guided between guide rails 8. While slat tilting bodies 24 are also arranged between legs 5 in chamber 4 of guide 1, there remains sufficient space between the slat tilting bodies and the facing inside walls of legs 5 to permit slat tilting bodies 24 to perform a movement transversely to the longitudinal extension of guide 1.

Referring to FIG. 6, part 28" of slat tilting body 24' has extension 35 carrying louvering hook 10 at the free end thereof. The louvering hook extends parallel to slats 12 in the direction of chamber 2 of guide 1 (see FIG. 1) and cooperates with louvering rocker 9. The louvering rocker is arranged in vertical guide 1 and has a substantially vertically extending inlet slot 36 having a downwardly inclined inlet plane 37. At the bottom of inlet slot 36, inclined duct 38 downwardly branches off the inlet slot which serves as a guide for louvering hook 10. Inclined inlet duct 38 ends in substantially vertical catch duct 39 having a lower end defined by a downwardly inclined outlet plane 40. An end of inclined outlet plane 40 leads to a substantially vertical sliding duct 44, which is separated from catch duct 39 and inclined inlet slot 36 by a wall 101. A switch tongue 41 is arranged at the end of inclined outlet plane 40, the switch tongue being pivoted above the inclined outlet plane to wall 101 separating sliding duct 44 from catch duct 39. The switch tongue may be a leaf spring, for example, and permits louvering hook 10 to be switched from catch duct 39 to sliding duct 44 but not from sliding duct 44 over inclined outlet plane 40 to catch duct 39. The pivot of switch tongue 41 on the separating wall is so positioned that the free end of the switch tongue engages inclined outlet plane 40 when it is pivoted clockwise, thus blocking further movement in that direction in a rest position while the switch tongue may evade louvering hook 10 when pivoted counterclockwise from catch duct 39 towards sliding duct 44 at the time the roller shutter is unwound from the winding drum and slats 12 move downwards as guide bodies 11 and slat tilting bodies 24 glide along vertical guide 1.

A catching hook 42 is arranged at the top of catch duct 39 and is downwardly open for engaging louvering hook 10. When louvering hook 10 has been lowered into catch duct 39 and, without having left the catch duct by way of inclined outlet plane 40, is raised again, which may be effected by rotation of the winding drum in the winding direction, the louvering hook engages catching hook 42. If the tension element is then pulled up a little, the slat tilting bodies 24, 24' and the slat tilting element cannot move with the tension element. Thus, crank 21 of shaft 16 causes the shaft to be rotated and slats 12 to be tilted.

When the tension element is unwound from the winding drum and the slats are lowered enough for louvering hook 10 to enter sliding duct 44 by way of inclined outlet plane 40, as illustrated in FIG. 6, the roller shutter may be pulled up again while louvering hook 10 glides unhindered up sliding duct 44 and presses a switch tongue 43 arranged in the upper portion of louvering rocker 9 out of the way. Switch tongue 43 may also be of spring steel.

Switch tongue 43 assures that louvering hook 10 dependably glides into inlet slot 36 when the roller shutter is lowered. As is clear from FIG. 6, switch tongue 43, which is held on wall 101 separating inlet slot 36 from sliding duct 44, can be pivoted in a clockwise direction only until it engages the inside wall of leg 5 in the rest position. Therefore, when the roller shutter is lowered, louvering hook 10 is deflected by switch tongue 43 into inlet slot 36 and prevented from entering sliding duct 44.

Figure 7:
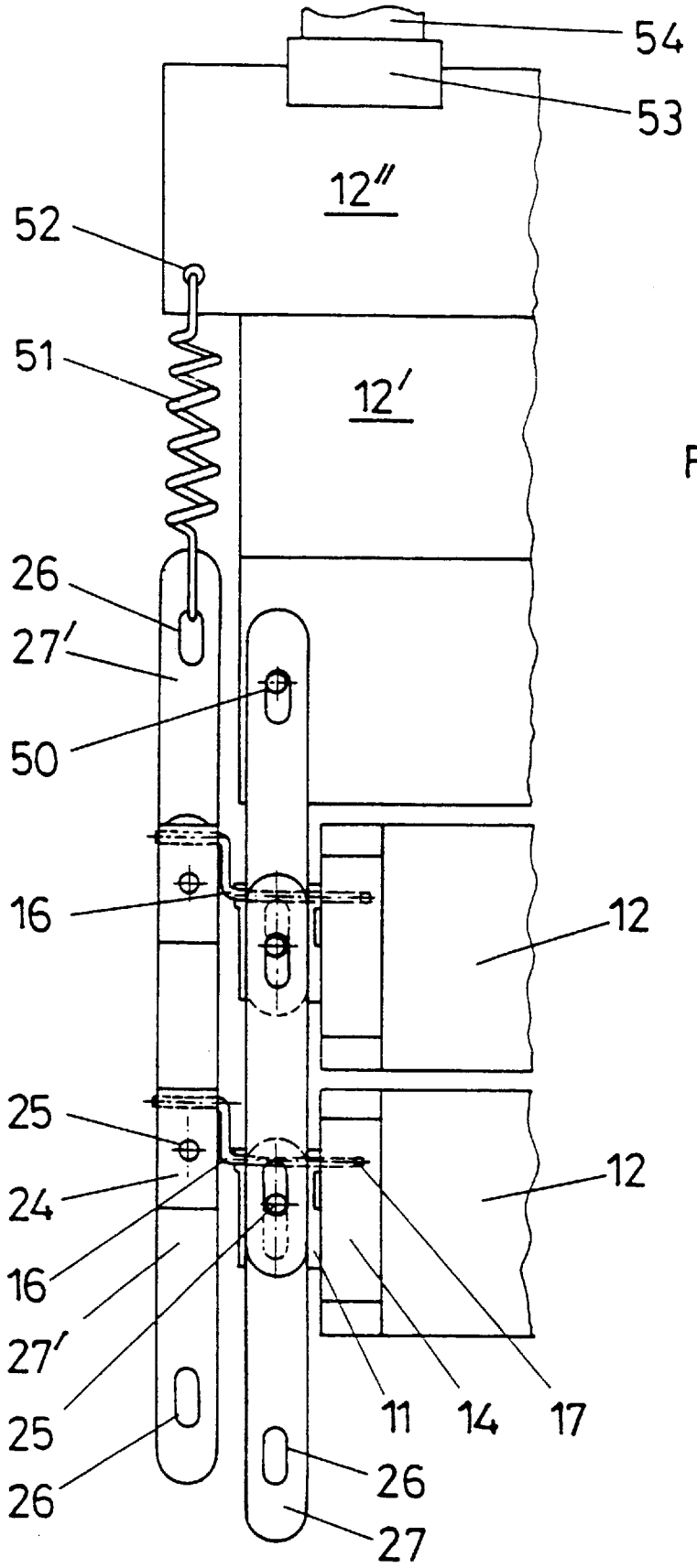
FIG. 7 is a fragmentary side elevational view of the uppermost portion of the roller shutter.

As shown in FIG. 7, longer slats 12', 12", which cannot be louvered, are arranged in the uppermost portion of the roller shutter. Slat 12" is affixed to holders 53 which are connected to the winding drum by straps 54. Slats 12" are long enough to extend over the slat tilting element and slat tilting bodies 24. The longer slats are hooked to each other along their longitudinally extending edges so that they may pivot in relation to each other. Slat 12" has at least one bore 52 at a lower edge thereof, which enables one end of a spring 51 to be hooked into the bore while its opposite end is hooked in elongated slot 26 of an uppermost member 27' of the slat tilting element. Slats 12' are long enough to extend over the tension element and guide bodies 11. The uppermost member 27 of the tension element is affixed to the lower one of slats 12' by rivet 50 passing through slot 26 of member 27. When louvering rocker 9 is hooked to louvering hook 10 and the roller shutter is raised a little, spring 51 will be stretched and slats 12 will be tilted into their louvered position, as explained hereinabove.

I claim:

1. A louverable roller shutter for covering an opening and comprising (a) a series of adjacent slats extending parallel to an axis of a winding drum, (b) a vertical guide at each end of the slats, (c) guide bodies received in the vertical guides and tiltably connected to the ends of the slats, (d) a tension element displaceably guided in the guide bodies for being wound up on the winding drum, (e) slat tilting bodies received in the vertical guides on a side of the guide bodies averted from the slat ends, (f) a slat tilting element displaceably guided in the slat tilting bodies for being wound up on the winding drum, (1) the tension element and the slat tilting element being comprised of at least one thin, flexible metal strip defining holes, (g) pins substantially perpendicularly intersecting the axis of the winding drum, each pin connected to a respective one of the guide bodies and the slat tilting bodies, the pins passing through the holes in the thin, flexible metal strips, and (h) shafts torsionally rigidly connected to the slat ends and extending parallel to the slats, each shaft passing through a respective one of the guide bodies and having an offset portion pivotally engaging a respective one of the slat tilting bodies.

2. The louverable roller shutter of claim 1, wherein the thin, flexible metal strips are of spring steel.

3. The louverable roller shutter of claim 1, wherein the thin, flexible metal strips of the tension element and of the slat tilting element comprise a plurality of overlapping members forming chains, each member defining two of said holes, the holes being elongated to extend in a longitudinal direction and the center points of the elongated holes being spaced from each other a distance corresponding to the width of the slats, and each of the pins passing through registering ones of the holes in the overlapping members.

4. The louverable roller shutter of claim 1, wherein the guide bodies and the slat tilting bodies are comprised of two parts, the tension element and the slat tilting element passes between the two parts, and the pins connect the two parts.

5. The louverable roller shutter of claim 1, wherein the guide bodies comprise lateral lugs extending towards the slat ends, the lugs providing stops defining a closing position of the tiltable slats wherein the slats extend substantially parallel to a plane defining the opening to be covered.

6. The louverable roller shutter of claim 1, further comprising a louvering rocker arranged in the vertical guide and at least one of the slat tilting bodies carries a louvering hook arranged to engage the louvering rocker, the louvering rocker defining a substantially vertically extending inlet slot and an inclined duct downwardly branching off the inlet slot and leading to a substantially vertical catch duct having a lower end defined by a downwardly inclined outlet plane, a catching hook is arranged above the point where the inclined duct branches off the inlet slot and is downwardly open for engaging the louvering hook, an end of the inclined outlet plane leading to a substantially vertical sliding duct, and further comprising a switch tongue arranged at the end of the inclined outlet plane, the switch tongue being held above the inclined outlet plane on a wall separating the sliding duct from the catch duct, and the switch tongue having a free end and being pivotal between a rest position wherein the switch tongue is downwardly inclined and the free switch tongue end engages the inclined inlet plane of the vertical catch duct, and a position wherein the free switch tongue end is pivoted into the vertical sliding duct.

7. The louverable roller shutter of claim 6, further comprising an inclined switch tongue having a free end and resiliently covering the inlet slot, the inclined switch tongue being held on a wall separating the vertical sliding duct from the inlet slot and extending obliquely upwardly over the sliding duct.

8. The louverable roller shutter of claim 7, the vertical sliding duct having a wall opposite the inlet slot and the free end of the inclined switch tongue engaging the opposite wall.

9. The louverable roller shutter of claim 7, wherein the switch tongues are of spring steel.

* * * * *